US008984686B2

(12) United States Patent
Lim et al.

(10) Patent No.: US 8,984,686 B2
(45) Date of Patent: Mar. 24, 2015

(54) PLATFORM OF ELECTRIC-MOVABLE BED FOR BEDSORE PREVENTION CAPABLE OF ADJUSTING SHAFT ACCORDING TO USER BODY TYPE AND METHOD FOR CONTROLLING POSITION CHANGE PERIOD THEREOF

(75) Inventors: Do Hyung Lim, Hwaseong (KR); Kyeoung Jin Chun, Uiwang (KR); Jae Soo Hong, Cheonan (KR); Hyun Ho Choi, Anyang (KR)

(73) Assignee: Korea Institute of Industrial Technology, Cheonan (KR)

( * ) Notice: Subject to any disclaimer, the term of this patent is extended or adjusted under 35 U.S.C. 154(b) by 194 days.

(21) Appl. No.: 13/699,626

(22) PCT Filed: Jun. 8, 2011

(86) PCT No.: PCT/KR2011/004208

§ 371 (c)(1),
(2), (4) Date: Nov. 22, 2012

(87) PCT Pub. No.: WO2011/155769

PCT Pub. Date: Dec. 15, 2011

(65) Prior Publication Data

US 2013/0061398 A1 Mar. 14, 2013

(30) Foreign Application Priority Data

Jun. 9, 2010 (KR) ..... 10-2010-0054512
Jun. 9, 2010 (KR) ..... 10-2010-0054513

(51) Int. Cl.

| | |
|---|---|
| ***A61G 7/015*** | (2006.01) |
| ***A61G 7/018*** | (2006.01) |
| ***A61G 7/057*** | (2006.01) |

(52) U.S. Cl.

CPC ..... *A61G 7/018* (2013.01); *A61G 7/015* (2013.01); *A61G 7/0573* (2013.01); *A61G 2200/18* (2013.01)

USPC ..... 5/618; 5/613; 5/617

(58) Field of Classification Search

CPC . A61G 2200/18; A61G 7/0573; A61G 7/015; A61G 7/018

USPC ..... 5/613, 617, 618

See application file for complete search history.

(56) References Cited

U.S. PATENT DOCUMENTS 610,089 A * 8/1898 Schrenkeisen ..... 5/617
6,360,386 B1 3/2002 Chuang (Continued)

FOREIGN PATENT DOCUMENTS

JP 2000-334002 A 12/2000
KR 10-2003-0078256 A 10/2003

(Continued)

*Primary Examiner* — William Kelleher
*Assistant Examiner* — David R Hare
(74) *Attorney, Agent, or Firm* — Patent Office of Chung Park

(57) ABSTRACT

There is disclosed a platform of an electric-movable bed for preventing bedsores and capable of changing a shaft including a plate unit. The platform includes a plurality of main plates rotatably provided to support the human body, a plurality of sub plates rotatably and hingedly coupled to the main plates, respectively, and a locking part provided between each main plate and each sub plate to enable or lock the rotation of each main plate or sub plate, the plate unit being configured to selectively rotate a corresponding portion to a position of the joint according to a user's body type; a first driving unit configured to tilt an upper part of the human body lying on the plate unit; and a second driving unit configured to tilt a lower part of the human body lying on the plate unit.

13 Claims, 18 Drawing Sheets

(56) References Cited

U.S. PATENT DOCUMENTS

| | | | | |
|---|---|---|---|---|
| 6,739,004 | B1 * | 5/2004 | Abrahamsen et al. | 5/610 |
| 6,986,180 | B1 | 1/2006 | Wilke | |
| 7,552,491 | B2 * | 6/2009 | Voelker | 5/612 |
| 8,347,433 | B1 * | 1/2013 | Shih | 5/613 |
| 2002/0152552 | A1 * | 10/2002 | Dewert | 5/618 |
| 2005/0120481 | A1 * | 6/2005 | Farmont et al. | 5/618 |
| 2006/0085913 | A1 * | 4/2006 | Kawakami et al. | 5/618 |
| 2009/0178201 | A1 * | 7/2009 | Lujan et al. | 5/618 |
| 2011/0138536 | A1 * | 6/2011 | Wernqvist et al. | 5/618 |

FOREIGN PATENT DOCUMENTS

| | | |
|---|---|---|
| KR | 10-0483984 | 6/2005 |
| KR | 10-0730803 | 6/2007 |
| WO | 97/20534 | 6/1997 |
| WO | 02-45641 | 6/2002 |

* cited by examiner

First Posture / Female Age: 45, Sacral Region

| Maintaining Time (min.) / Weight (kg) | 15 | 30 | 45 | 60 | ..... |
|---|---|---|---|---|---|
| 35 | 5 | 6 | 7 | 9 | |
| 38 | 5 | 6 | 7 | 9 | ..... |
| 40 | 5 | 6 | 7 | 10 | |
| 43 | 5 | 6 | 7 | 10 | |
| 45 | | | | | |
| ⋮ | | ⋮ | | | |

FIG. 27

Second Posture / Female, Age: 48, Sacral Region

| Weight (kg) \ Maintaining Time (min.) | 15 | 30 | 45 | 60 | ····· |
|---|---|---|---|---|---|
| 35 | 5 | 6 | 8 | 10 | |
| 38 | 5 | 6 | 8 | 10 | |
| 40 | 6 | 6 | 8 | 10 | ····· |
| 43 | 6 | 6 | 8 | 11 | |
| 45 | 6 | 6 | 9 | 11 | |
| ⋮ | | | ⋮ | | |

PLATFORM OF ELECTRIC-MOVABLE BED FOR BEDSORE PREVENTION CAPABLE OF ADJUSTING SHAFT ACCORDING TO USER BODY TYPE AND METHOD FOR CONTROLLING POSITION CHANGE PERIOD THEREOF

CROSS-REFERENCE TO PRIOR APPLICATIONS

This application is a national Stage Patent Application of PCT International Patent Application No. PCT/KR2011/004208, filed on Jun. 8, 2011 under 35 U.S.C. §371, which claims priority of Korean Patent Application Nos. 10-2010-0054512, filed on Jun. 9, 2010 and 10-2010-0054513 filed on Jun. 9, 2010, which are all hereby incorporated by reference in their entirety.

TECHNICAL FIELD

The present invention relates to a electric-movable bed for a patient, more particularly, to a platform for an electric-movable bed which is able to provide an optimized shaft for a patient by changing a shaft according to a patient body type and to automatically change a patient position to prevent bedsores generated in a patient lying on a bed.

BACKGROUND

Generally, a serious patient such as a quadriplegic who is not able to move about freely spend most time of a day on lying on a bed or sitting on a wheelchair, with help of care workers or family dependents. As the old population has been increasing, the population lying on beds because of old age or dementia has been increasing.

However, overpressure is locally applied to a patient lying or sitting for a long time in the back, bottom touching a surface of a bed or wheelchair. A blockage of capillary blockage is continued by such overpressure constantly and repeatedly applied to the local part of the patient body. Accordingly, blood fails to flow through a skin tissue of the body part only to generate bedsores.

The tension applied to the location of the bedsore and the time of the tension activation can be important in this case. In an early stage, there is no damage to the skin tissue but discoloration on the location. As the bedsore is advanced, a sore starts to occur in a skin epidermal tissue and the inner skin under the skin epidermal tissue happens to be damaged. Even in a severe case, the bedsore can damage to the muscle or osseous tissue.

Moreover, such the patient might have a great pain enough to destroy the quality of the life. First of all, in case the bedsore happens to the patient unable to move freely, the recovery speed is slow according to characteristics of the elderly patient or patient unable to move freely and it might be quite difficult for such the patient to recover from the bedsore and the sore is subject to aggravation. There may be quite social costs of the economical loss required by the expense of treating the bedsore and of the death of the patient.

To solve such problem, there are many hospitals using electric-movable beds recently.

Such an electric-movable bed 10 can have a back supporting part 12 supporting the human back and a leg supporting part 14, of which angles are adjusted in an electric type to change the patient's position easily to make easy to take care of the patient advantageously.

However, every patient has a different body type and the locations of the bottom and knee can be differentiated according to the body type. In a conventional electric-movable bed, a rotating portion is fixed. Accordingly, the patient might have a wrong position if the patient's body type is not fitted to the electric-movable bed, only to cause the patient's uncomfortable feeling. Also, if such a wrong position is repeated for a long time, musculoskeletal system disorder might be caused. As the conventional electric-movable bed has no function of changing the patient body type periodically and automatically, such that the load and shear force applied to a specific skin location only to generate bedsores disadvantageously.

Moreover, to prevent the bedsores from occurring in the patient lying on the bed, the angle of the supporting part provided in the electric-movable bed is changed on a regular cycle. Even when changing the position of the patient with the change of the angle on the regular cycle, such a position change cycle might be applied uniformly, not be optimized according to the patient's sex, age, weight and other personal characteristics of the patient. Accordingly, optimized position change cycle for each patient cannot be provided disadvantageously.

DISCLOSURE

Technical Solution

To achieve these objects and other advantages and in accordance with the purpose of the embodiments, as embodied and broadly described herein, a platform of an electric-movable bed for preventing bedsores capable of changing a shaft includes a plate unit comprising a plurality of main plates rotatably provided to support the human body, a plurality of sub plates rotatably and hingedly coupled to the main plates, respectively, and a locking part provided between each main plate and each sub plate to enable or lock the rotation of each main plate or sub plate, the plate unit configured to selectively rotate a corresponding portion to a position of the joint according to a user's body type; a first driving unit configured to tilt an upper part of the human body lying on the plate unit; and a second driving unit configured to tilt a lower part of the human body lying on the plate unit.

The plurality of the sub plates may be provided, corresponding to a location of the human bottom and a location of the human knees.

The locking part may include an upper locking body provided in a lateral surface of a main plate or a sub plate out of neighboring main or sub plates; a lower locking body rotatably provided under the other main or sub plate out of two neighboring main or sub plates, the lower locking body extended to a lower portion of the upper locking body; and a locking rod coupled to one of the upper and lower locking bodies, with being extended to be selectively fixed to the other one, the locking rod configured to selectively lock the rotation of the neighboring main or sub plates.

The lower locking body may be rotatable in the same direction as the rotational direction of the main plates and the sub plates.

The locking rod may be rotatably coupled to the upper locking body and selectively fixed to the lower locking body.

A sensor may be provided in the locking part to sense whether the upper locking body, the lower locking body and the locking rod composing the locking part are connected and locked to each other.

The first driving unit may include a first base; a first motor provided in the first base; a first screw shaft rotated by the rotation of the first motor, with being extended in a longitudinal direction of the human body lying on the plate unit, the first screw shaft having a screw thread formed in an outer circumferential surface thereof; a first hinge formed in a position extended upward from the first base; a first rail provided in the first base in the longitudinal direction of the human body lying on the plate unit; a first slider engaging with the first screw shaft rotated by the first motor to be transferred along the first rail together with the rotation of the first screw shaft, the first slider having a second hinge formed at a position having a different height from the height of the first hinge; and a first bar hingedly coupled to the first hinge and hingedly coupled to the second hinge at a position having a different height from the first hinge, to rotate on the first hinge as the first slider is transferred to make an end thereof move the main or sub plate upward.

A first roller may be provided in an end of the first bar which contacts with the main or sub plate.

The platform of the electric-movable bed for preventing bedsores capable of changing the shaft may further include a position adjusting unit configured to adjust a position of the first driving unit.

The position adjusting unit may include a under base provided under the first base; a under rail provided in the under base to slidingly support the first base; and a fixing part configured to fix the position of the first base by restricting the moving of the first base along the under rail.

The fixing part may include a plurality of fixing grooves formed in the under base along a longitudinal direction; a fixing projection rotatably projected from the first base downward to be inserted in one of the fixing grooves to fix the first base to the under base; and a lever configured to rotate the fixing projection to selectively separate the fixing projection from the fixing groove.

The second driving unit may include a second base; a second motor provided in the second base; a second screw shaft rotated by the rotation of the second motor, with being extended in a longitudinal direction of the human body lying on the plate unit, the second screw shaft having a screw thread formed in an outer circumferential surface thereof; a third hinge formed in a position extended upward from the second base; a second rail provided in the second base in the longitudinal direction of the human body lying on the plate unit; a second slider engaging with the second screw shaft rotated by the second motor to be transferred along the second rail together with the rotation of the second screw shaft, the second slider having a fourth hinge formed at a position having a different height from the height of the third hinge; and a second bar hingedly coupled to the third hinge and hingedly coupled to the fourth hinge at a position having a different height from the third hinge, to rotate on the third hinge as the second slider is transferred to make an end thereof move the main or sub plate upward.

A second roller may be provided in a contacting portion of the second bar with the main or sub plate.

The platform of the electric-movable bed for preventing bedsores capable of changing the shaft may further include an input unit configured to input data on the user's physical conditions thereto.

In another aspect of the present invention, a method for controlling a posture changing cycle of a platform of an electric-movable bed for preventing bedsores capable of changing a shaft comprising a plate unit configured to allow a user to lie thereon, the plate unit comprising a plurality of rotatable plates to form a supporting surface to change a user's posture; a driving unit configured to change an angle of each plate; and an input unit configured to input data on a user's physical conditions thereto, the platform further comprising a control unit having a database for a risk level of bedsore occurrence at a specific location of the human body for a user's specific posture, wherein the control unit applies data on the user's physical conditions inputted based on the data for the risk level of the bedsore occurrence at the specific location of the human body for the user's specific posture input to the database to drive the driving unit to prevent the bedsores to change a posture of the plate unit on a predetermined cycle.

Data on a risk level of bedsore occurrence for each specific location of the human body based on the posture maintaining time for maintaining a specific posture may be inputted to the database.

The risk level of the bedsore occurrence may be configured to evaluate the risk level of the bedsore occurrence as data including at least one of a pressure applied to each location of the human body, shear forces, tcpCO2 and tcpO2.

The risk level of the bedsore occurrence may be configured to evaluate the risk level of the bedsore occurrence based on at least one of the user's weight, age and sex.

A weighted value of bedsore occurrence risk based on the user's specific disease or physical constitution may be applied to the database.

Advantageous Effects

The platform of the electric-movable bed for preventing bedsores capable of changing the shaft based on a user's body constitution and a method for controlling a posture changing cycle thereof according to the present invention have following advantageous effects.

First of all, one shaft fitted to the patient's body constitution can be selectively rotated out of the plurality of the shafts. Accordingly, the patient may lie on the bed more comfortably and various diseases generated by the wrong postures can be prevented. Accordingly, the patient's life may be enhanced.

Furthermore, the optimized posture changing cycle for each user can be provided and the user may feel comfortable. Also, the bedsore occurrence possibilities can be lowered remarkably. Together with the enhancement of the user's life quality, the care's improved convenience and the reduction of the treatment costs can be expected.

BRIEF DESCRIPTION OF THE DRAWINGS

FIG. 19(*a*) is a diagram illustrating change of the tilted angle of the first main plate according to the motion of the shaft of the first main plate, when the position of the first driving unit is fixed; and FIG. 19(*b*) is a diagram illustrating a tilted angle of the first main plate according to the moving position of the first driving unit;

FIG. 27 is a diagram illustrating another example of the database according to the aspect of the present invention shown in FIG. 26.

BEST MODE

Figure 1:
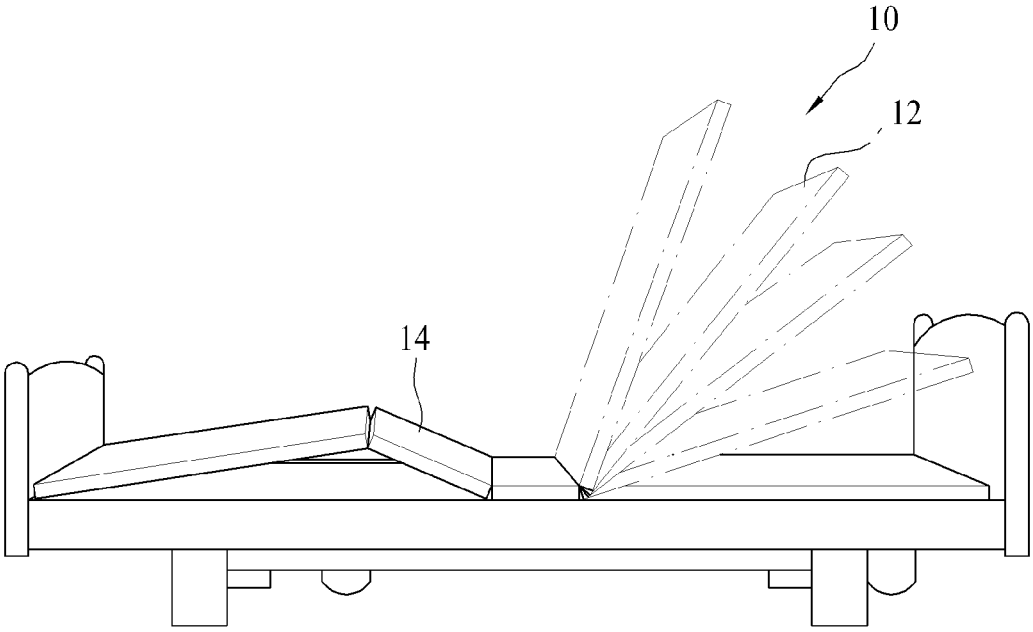
FIG. 1 is a perspective view illustrating a conventional electric-movable bed.

Embodiments of the present invention will be described in detail in reference to the accompanying drawings and contents disclosed in the drawings and the present invention is not limited to the embodiments. Reference may now be made in detail to specific embodiments, examples of which may be illustrated in the accompanying drawings. Wherever possible, same reference numbers may be used throughout the drawings to refer to the same or like parts.

A platform for an electric-movable bed capable of adjusting a shaft based on a user's body type (hereinafter, a platform) according to one embodiment of the present invention may include a plate unit 102, a first driving unit 150, a second driving unit 170 and a frame 106.

Figure 2:
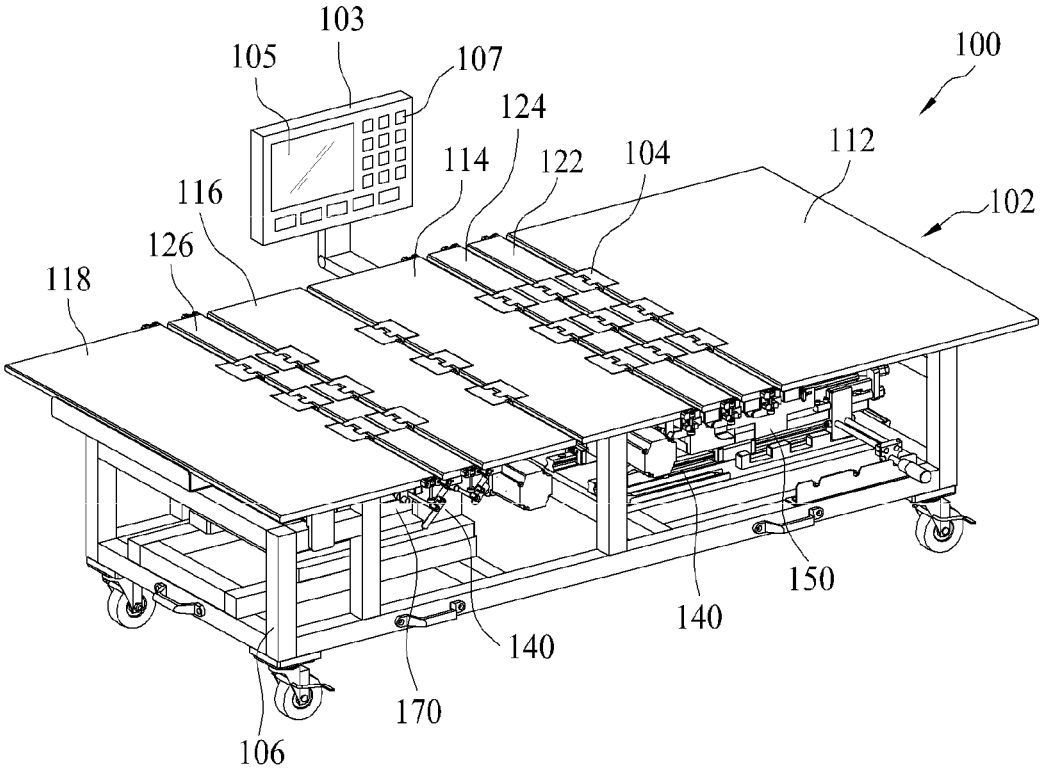
FIG. 2 is a perspective view illustrating one embodiment of a platform for an electric-movable bed that is able to change a shaft according to a user's body type.
Figure 3:
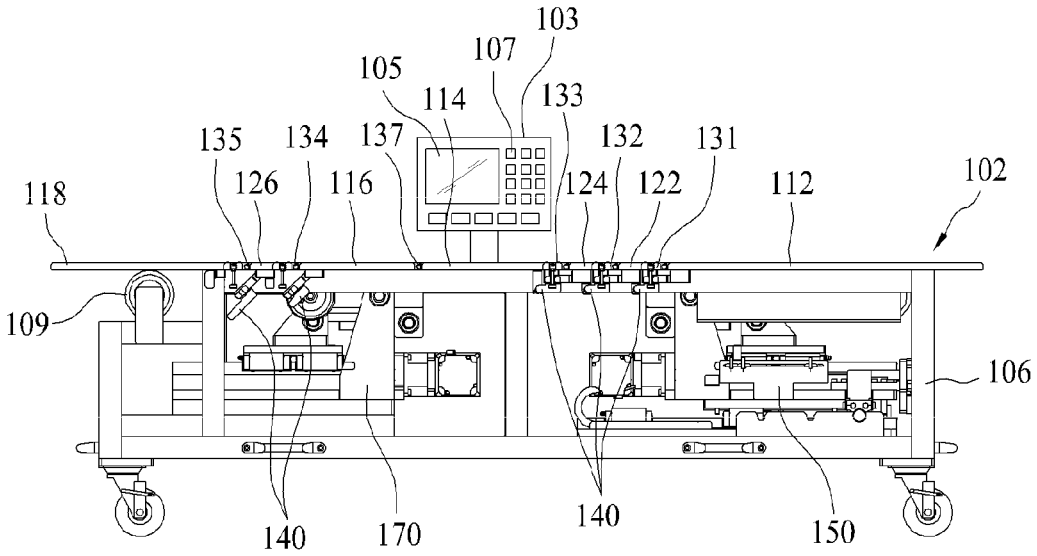
FIG. 3 is a side view of FIG. 2.

As shown in FIGS. 2 and 3, the plate unit 102 may include main plates 112, 114, 116 and 118, sub plates 122, 124 and 126 and a locking part 140.

The main plates 112, 114, 116 and 118 may be configured of a first main plate 112 supporting the human back, a second main plate 114 supporting the human bottom, a third main plate 116 supporting the human thighs and a fourth plate 118 supporting human calves.

A first sub plate 122 and a second sub plate 124 are provided between the first main plate 112 and the second main plate 114. The first main plate 112, the first sub plate 122, the second sub plate 124 and the second main plate 114 are rotatably connected with neighboring main plates or sub plates by a hinge, respectively.

Also, a third sub plate 126 may be provided between the third main plate 116 and the fourth main plate 118. The first main plate 116, the third sub plate 126 and the fourth main plate 118 are rotatably connected with neighboring main plates or sub plates by a hinge.

No sub plate is provided between the second main plate 114 and the third main plate 116 and the second main plate 114 and the third main plate 116 are directly connected with each other by a hinge.

The locking parts 140 are provided between the main plates and the sub plates, respectively, except between the second main plate 114 and the third main plate 116, only to selectively restrict the rotations between the main plates and the sub plates. The locking parts 170 will be described in detail later.

In the description of this embodiment, the hinge between the first main plate 12 and the first sub plate 122 may be referenced to as 'a first variable hinge 131'. The hinge between first sub plate 122 and the second sub plate 124 is referenced to as 'a second variable hinge 132'. The hinge between the second sub plate 124 and the second main plate 114 may be referenced to as 'a third variable hinge'.

Moreover, the hinge between the third main plate 116 and the third sub plate 126 may be referenced to as 'a fourth variable hinge 134' and the hinge between the third sub plate 126 and the fourth main plate 118 may be referenced to as 'a fifth variable hinge 135'.

Meanwhile, the hinge between the second main plate 114 and the third main plate 116 with no locking part 140 may be referenced to as 'a fixed hinge 137'.

In other words, the first to third variable hinges 131 to 133 are corresponding to the locations of the human hip joints. The fourth and fifth variable hinges 134 and 135 are corresponding to the human knee locations.

The first driving unit 150 is a component element for tilting the first main plate 112 to raise an upper part of the human body.

The second driving unit 170 is a component element for tilting the third main plate 116 to support the human thigh locations to close the human legs.

The frame 106 supports the plate unit 102. The first driving unit 150 and the second driving unit 170 are mounted in the frame 106. For moving convenience sake, the frame 106 may include a handle and wheels located in a lower portion thereof. Of course, a locking mechanism for locking the rotation of the wheels may be provided in the wheels 108.

The first driving unit 150 and the second driving unit 170 will be described in detail later. The locking parts 140 will be described in detail as follows.

As shown in FIGS. 2 and 3, the locking parts 140 may be provided in the first variable hinge 131 and the fifth variable hinge 135, respectively.

More specifically, as shown in FIGS. 4 to 7, the restricting part 140 may include an upper locking body 141, a lower locking body 142 and a locking rod 144.

The upper locking body 141 may be formed in a lateral portion of either of two neighboring main or sub plates 112, 114, 116 and 118 or 122, 124 and 126.

The lower locking body 142 is provided in opposite to the upper locking body 141. The lower locking body 142 is rotatably coupled to a bottom surface of another main plate or sub plate located in opposite to the main or sub plate where the upper locking body 141 is provided. When it is unfolded, the lower locking body 142 may face the upper locking body 141, with being positioned under the upper locking body 141.

The locking rod 144 has an end hingedly coupled to the upper locking body 141 and the other end extended to be selectively fixed to the lower locking body 142.

Also, an inserting hole 143 is formed in the lower locking body 142 to pass the locking rod 144 there through.

A fastening bolt 145 having a larger area than the inserting hole 143 is provided in an edge of the locking rod 144 where the lower locking body 142 is coupled. When the locking rod is coupled to the lower locking body 142, the fastening bolt may fasten the coupling.

Figure 4:
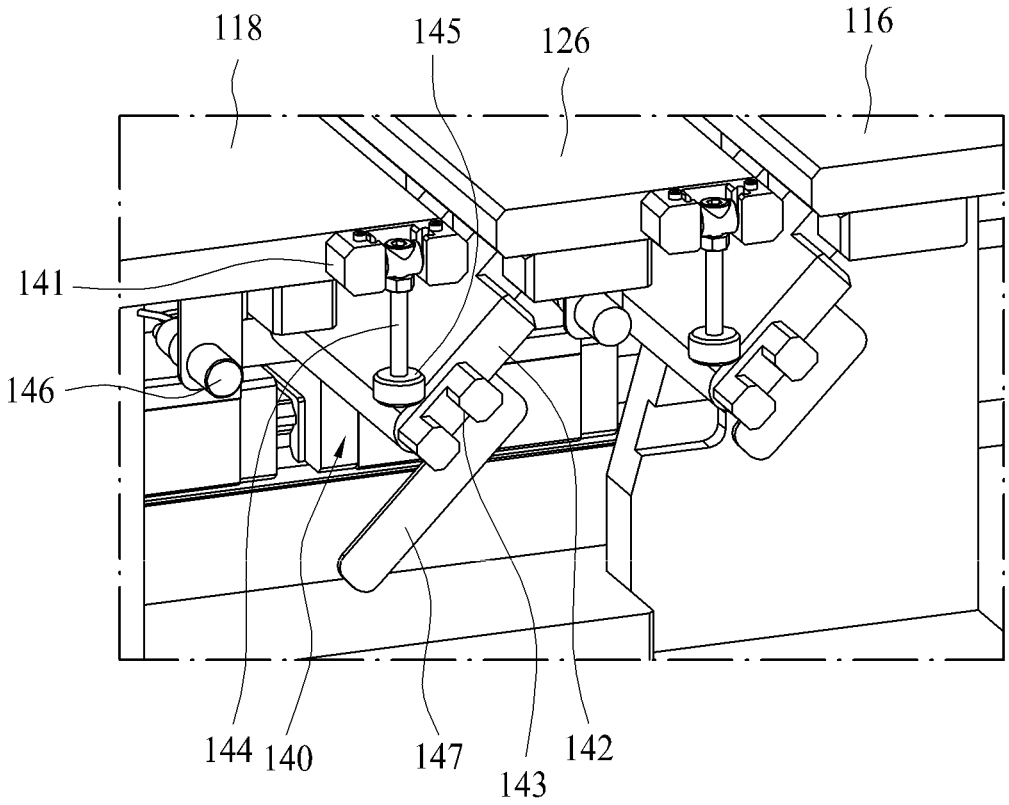
FIG. 4 is a perspective view illustrating a locking part of the platform shown in FIG. 2, which is in an unlocked state.
Figure 5:
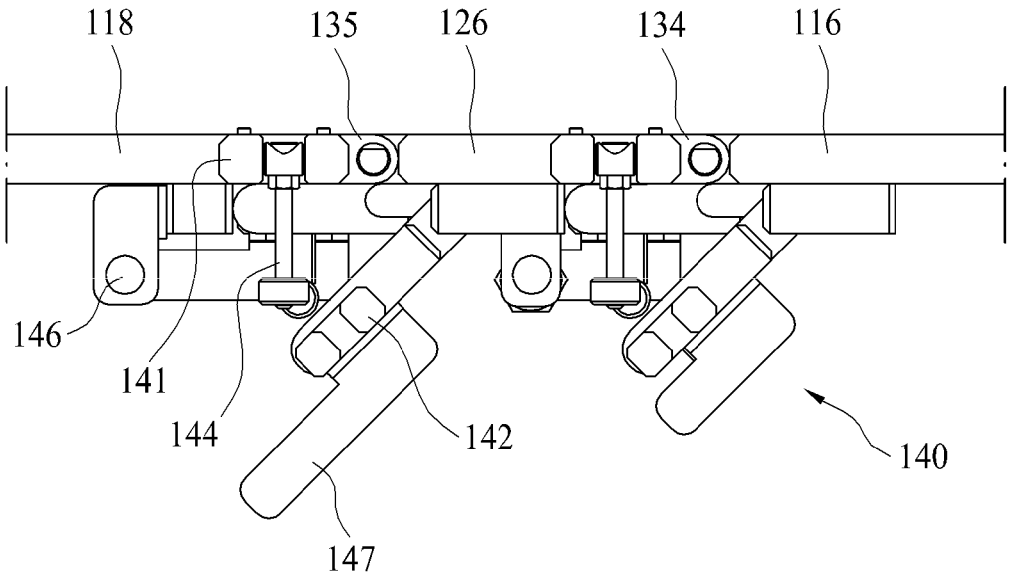
FIG. 5 is a side view of the FIG. 4.
Figure 6:
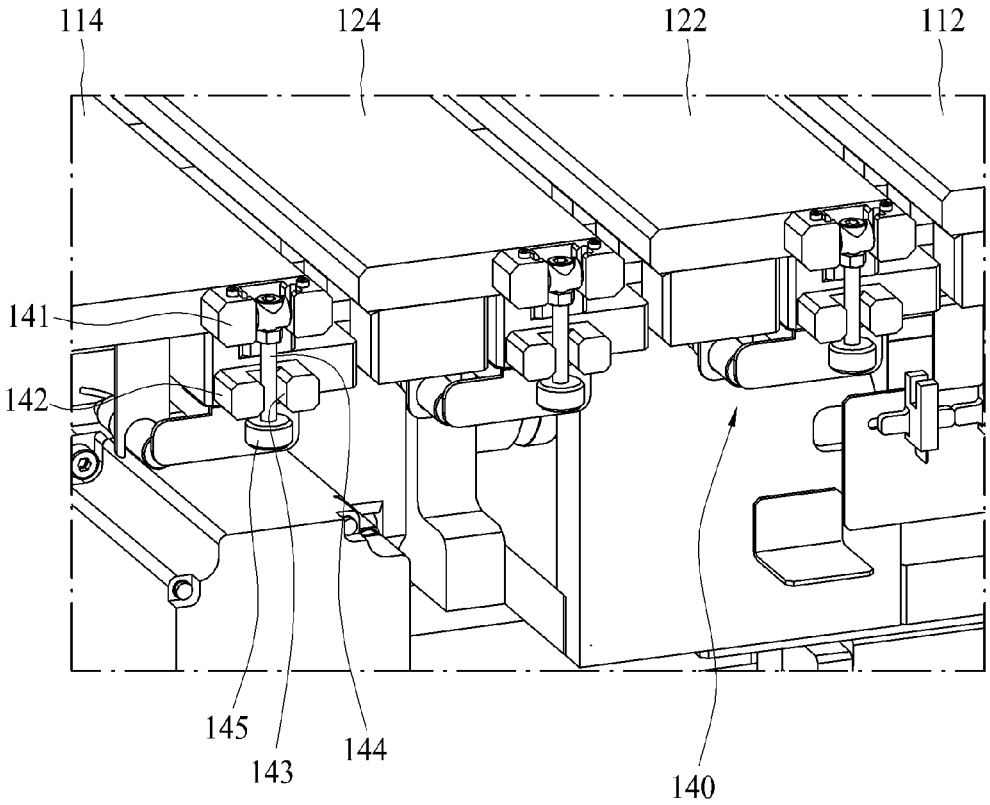
FIG. 6 is a perspective view illustrating a locking part of the platform shown in FIG. 2, which is in a locked state.
Figure 7:
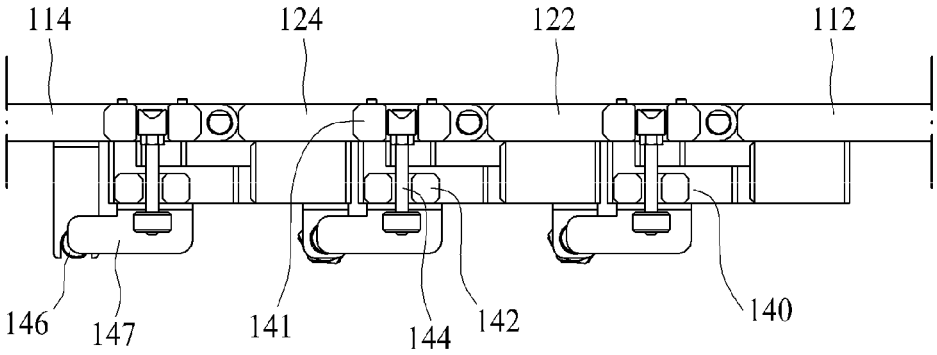
FIG. 7 is a side view of FIG. 6.
Figure 8:
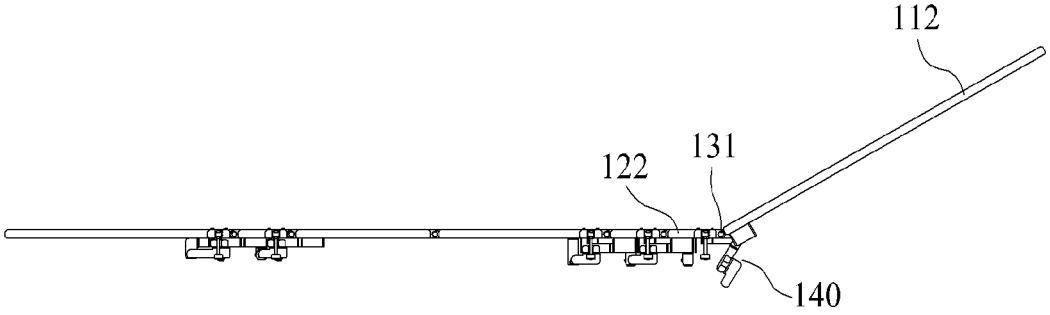
FIG. 8 is a side view illustrating a first main plate of a plate unit provided in the platform shown in FIG. 2, which is rotated with respect to a first variable hinge.
Figure 9:
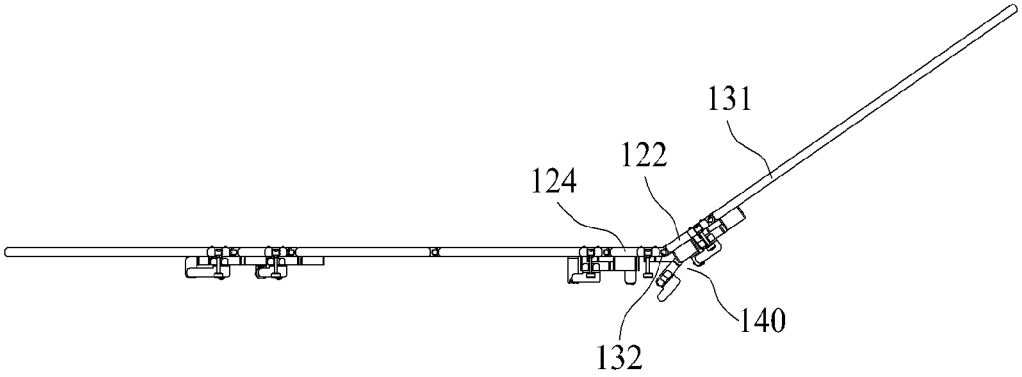
FIG. 9 is a side view illustrating the first main plate of the plate unit which is rotated with respect to a second hinge.
Figure 10:
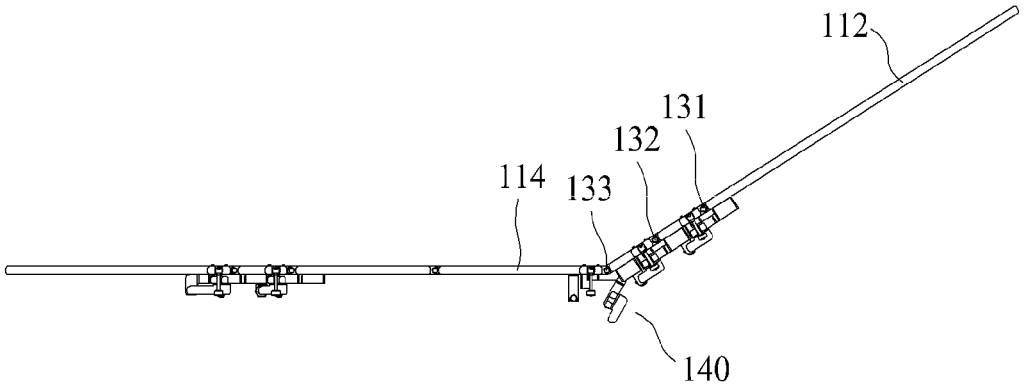
FIG. 10 is a side view illustrating the first main plate of the plate unit which is rotated with respect to a third hinge.
Figure 11:
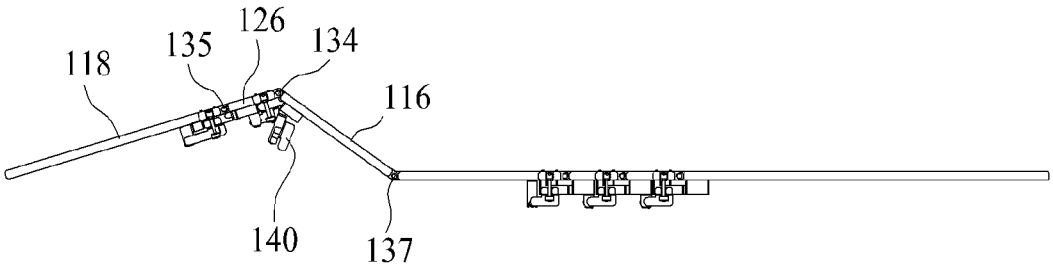
FIG. 11 is a side view illustrating a fourth main plate of the plate unit which is rotated with respect to a fourth hinge.
Figure 12:
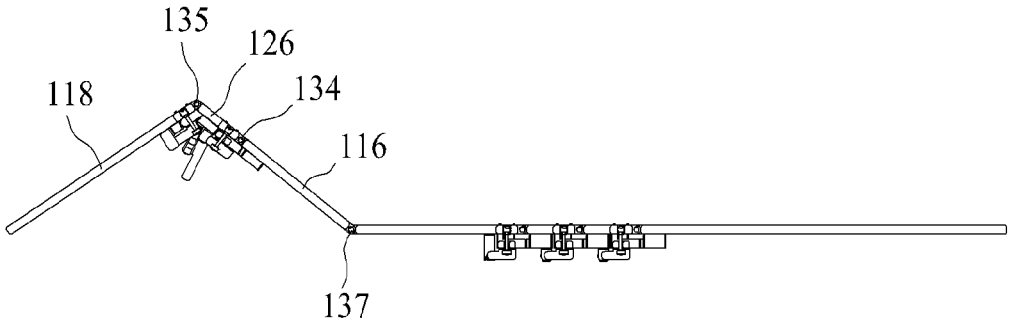
FIG. 12 is a side view illustrating the fourth main plate of the plate unit which is rotated with respect to a fifth hinge.

Accordingly, as shown in FIGS. 4 and 5, the locking part 140 is unlocked when the locking rod 144 is not coupled to the lower locking body 142. As shown in FIGS. 6 and 7, the locking rod 144 is positioned in the inserting hole 143 of the lower locking body 142 in a state where the lower locking body 142 is unfolded to be positioned under the upper locking body 141. After that, the fastening bolt 145 is fastened to securely fasten the lower locking body 142, only to complete the locking of the locking part 140.

In other words, the first to fifth variable hinges 131 to 135 are rotated or locked according to the locking of the locking part 140, only to adjust the position rotated based on the user's body type as shown in FIGS. 8 to 12.

Moreover, a sensor 146 may be further provided to sense which one of the locking parts 140 provided in the first to fifth variable hinges 131 to 135, respectively, is in a locked state.

Specifically, as shown in FIGS. 4 and 5, the sensor 146 is provided under the upper locking body 141 and it includes a sensed part 147 extended from the lower locking body 142, to be sensed by the sensor 146 by facing the sensor 146 when the lower locking body 142 is unfolded. In other words, when the lower locking body 142 is positioned under the upper locking body 141 as a locked position, the sensed part 147 is overlapped with the sensor 146 and the sensor 146 senses that the locking part 140 is in the locked state.

Also, as shown in FIGS. 2 and 3, an input unit 103 may be provided in one surface of the plate unit 102 or the frame 106. The input unit 103 may consist of a display 105 and a keypad 107. The user may select an operational mode of the platform 100, using the display 105 and the keypad 107, and he or she may input a variety of information on body conditions including the user's age, height and weight and physical constitution or diseases. Although not shown in the drawings, a terminal connected to an external device and the like may be provided in the input unit 103 to input or output various data.

Figure 13:
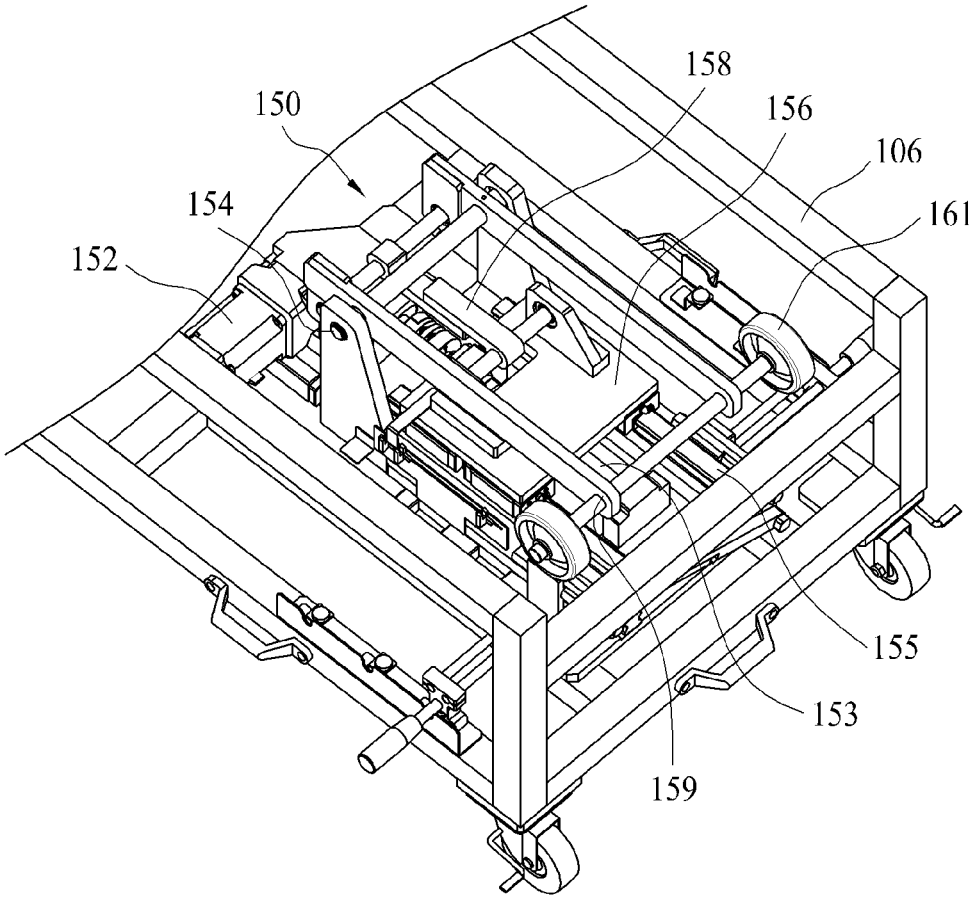
FIG. 13 is a perspective illustrating a first driving unit of FIG. 2.
Figure 14:
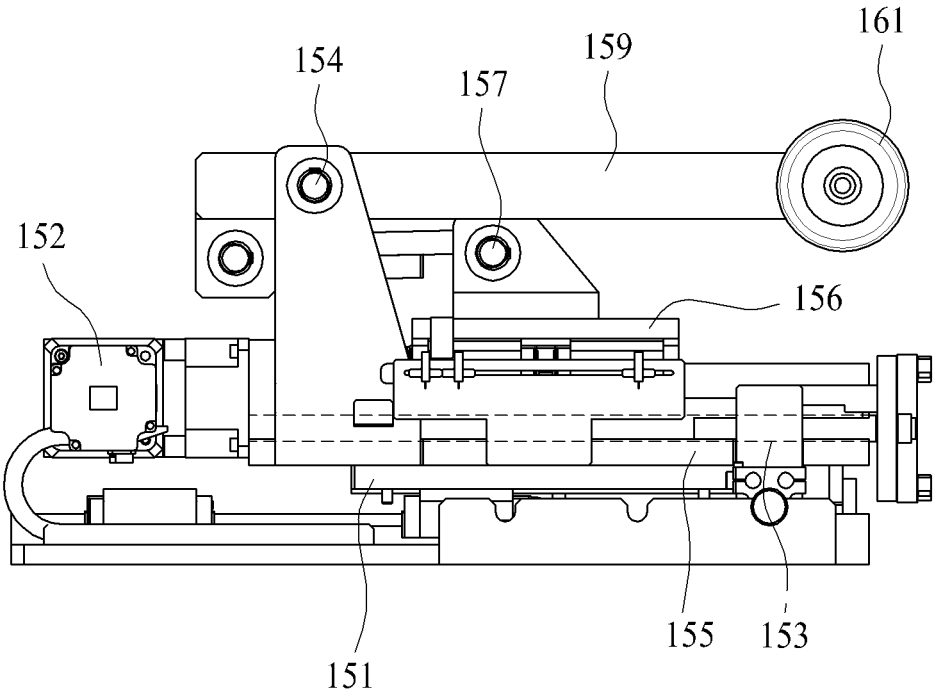
FIG. 14 is a side view illustrating the first driving unit of FIG. 13.
Figure 15:
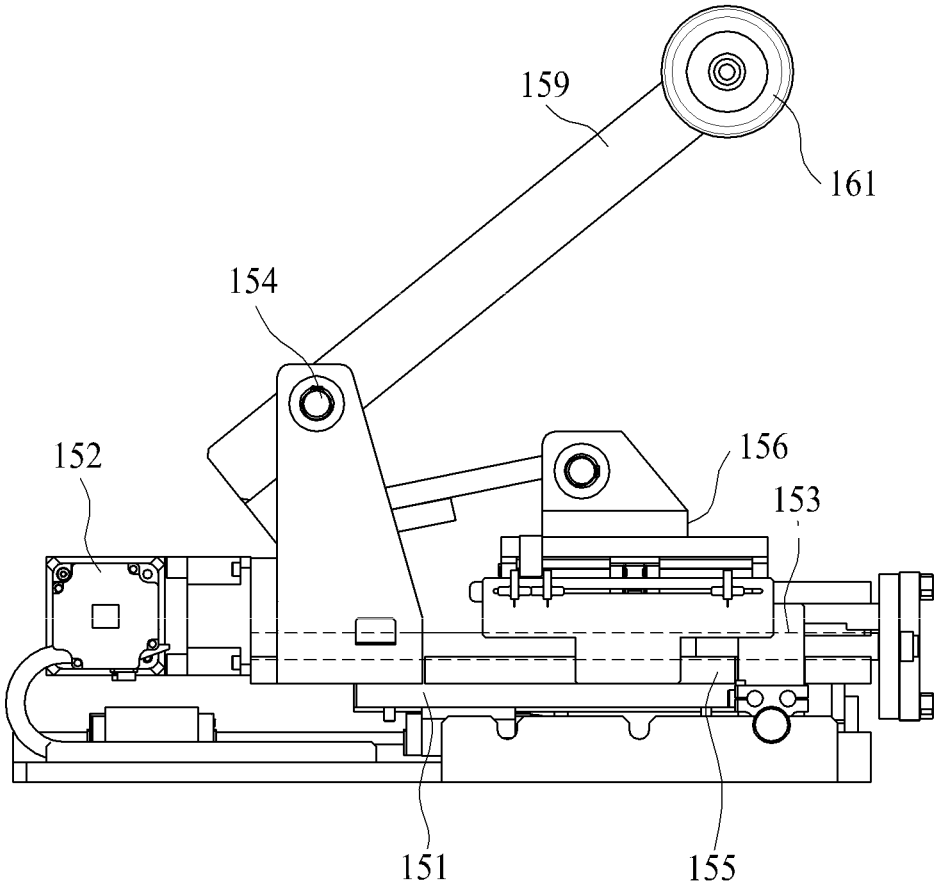
FIG. 15 is a side view illustrating a first bar of the first driving unit shown in FIG. 14, which is rotated to move upward.

The first driving unit 150 is a component element for tilting the first main plate 112 to raise the upper part of the human body. As shown in FIGS. 13 to 15, the first driving unit 150 may include a first base 151, a first motor 152, a first screw shaft 153, a first hinge 154 a first rail 155, a first slider 156 and a first bar 159.

The first base 151 is provided underneath the plate unit 102 in the frame 106. The first motor 152 is provided in the first base 151 to provide a clockwise/counter-clockwise rotational force. The first screw shaft 153 is rotated in a clockwise direction by the first motor 152 and a screw thread is formed in an outer circumferential surface of the first screw shaft 153 and it is extended in a longitudinal direction of the human body lying on the plate unit 102. The first hinge 154 is extended upward from the first base 151. The first rail 155 is formed in a longitudinal direction of the human body lying on the plate unit 102.

The first slider 156 is provided beyond the first rail 155 and it engages with the first screw shaft 153 to sliding-reciprocate the first rail 155 along the clockwise/counter-clockwise direction rotation. The second hinge 157 is provided in the first slider 156.

A middle portion of the first bar 159 is hingedly coupled to the first hinge 154 and an end of the first bar 159 is connected to the second hinge 157 via the first link 158. At this time, the linked portion of the first bar 159 with respect to the second hinge 157 may be positioned at a position having the different height from the height of the first hinge 154. For that, an end of the first bar 159 may be bending downward and the bent portion is linked to the second hinge 157. The other end of the first bar 159 is extended a predetermined length and a first roller 161 is provided in the end of the first bar 159. The first bar 159 may be arranged in a position corresponding to a lower portion of the first main plate 112. The first roller 161 may be provided in a predetermined portion of the first bar toward the human head.

Accordingly, when the first motor 152 is rotated in a clockwise direction as shown in FIG. 15, the first screw shaft 153 is rotated by the rotational force of the first motor 152. As it is moving, the first slider 156 engaging with the first screw shaft 153 pulls the end of the first bar 159 via the first link 158 and the portion of the first bar 159 coupled to the first link 158 is lower than the first hinge 154. As a result, the other end of the first bar 159 is moved upward and the first bar 159 is rotated along the upward moving. After that, the first roller 161 provided in the end of the first bar 159 lifts the first main plate 112 and the first main plate 112 is rotated with respect to one of the first to third variable hinges 131 to 133 locked by no locking parts, to be tilted.

When the first motor 152 is rotated in the counter-clockwise direction, the reverse driving is performed and the first bar 159 is dropped and the first main plate 112 is rotated to be unfolded.

Figure 16:
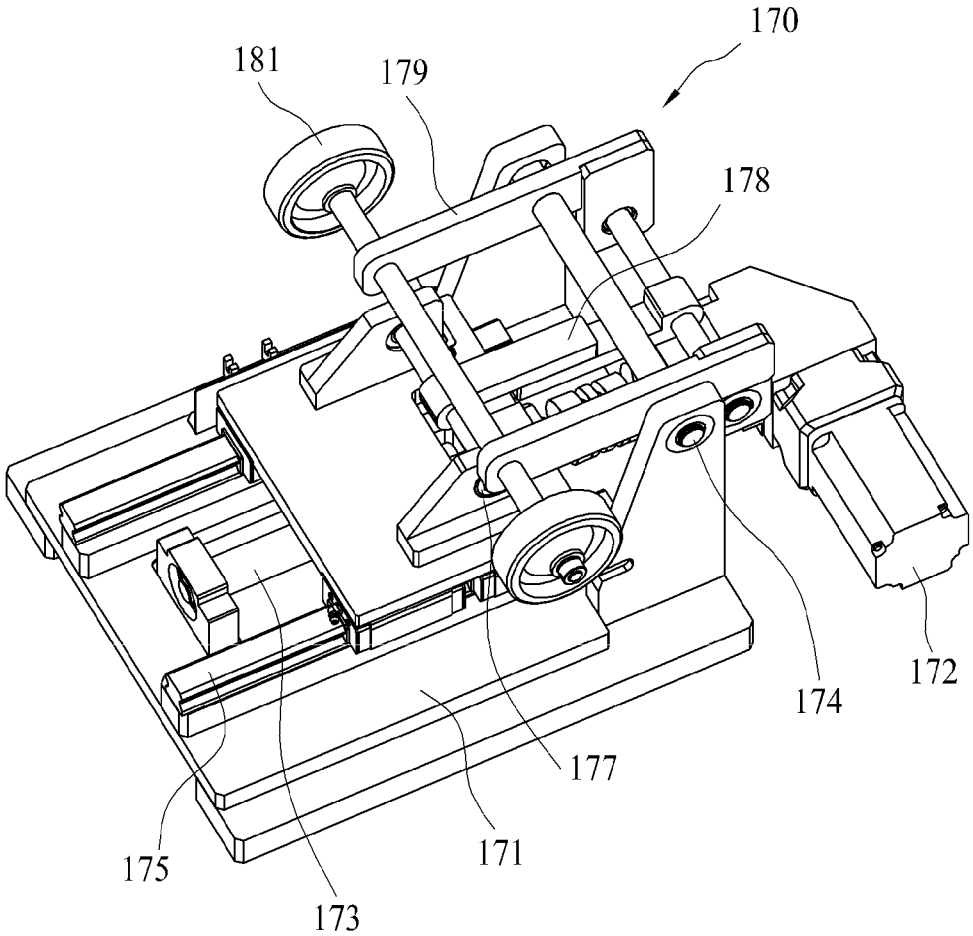
FIG. 16 is a perspective view illustrating a second driving unit of FIG. 2.
Figure 17:
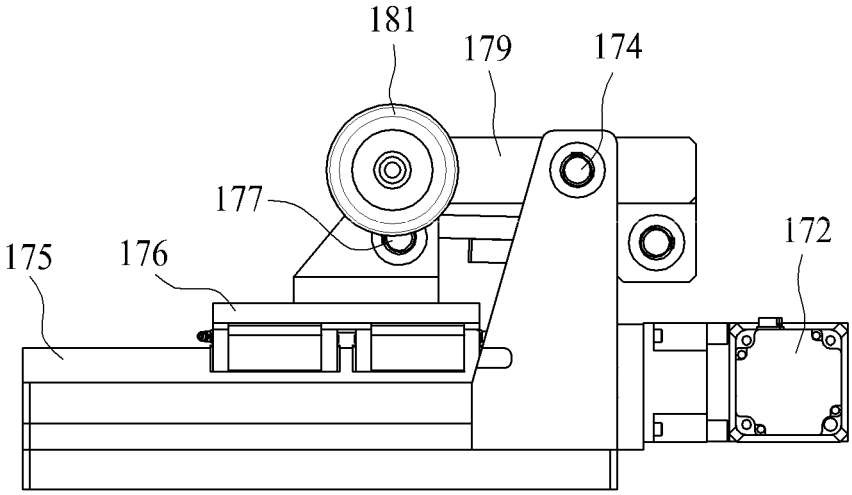
FIG. 17 is a side view illustrating a second driving unit of FIG. 16.
Figure 18:
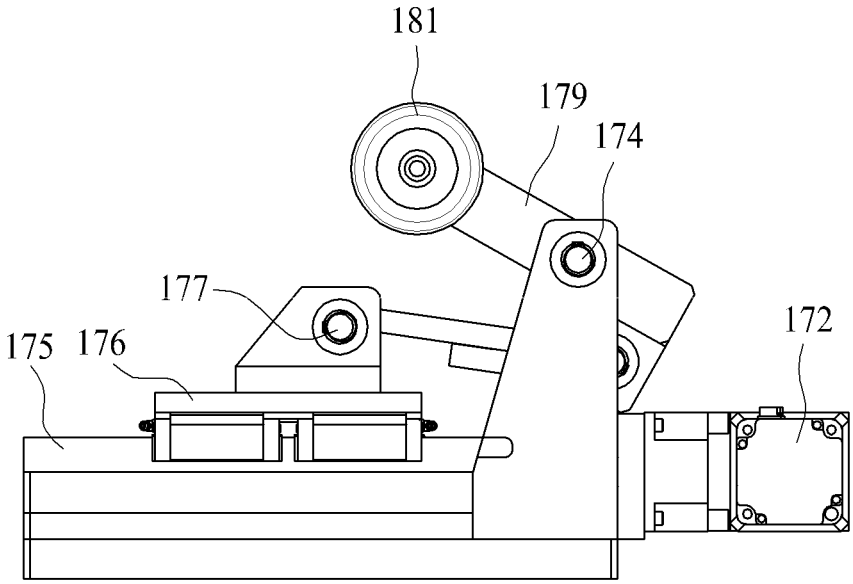
FIG. 18 is a side view illustrating a second bar of the second driving unit of FIG. 16, which is rotated to move upward.

The second driving unit 170 is a component for tilting the first main plate 116 and the fourth main plate 118 to raise the human legs. As shown in FIGS. 16 to 18, the second driving unit 170 may include a second base 171, a second motor 172, a second screw shaft 173, a third hinge 174, a second rail 175, a second slider 176 and a second bar 179.

The second driving unit 170 has a similar configuration to the first driving unit 150 described above. Specifically, the second base 171 is provided under the plate unit 102 in the frame 106. The second motor 172 is provided in the second base 171 to provide a clockwise/counter-clockwise rotational force. The second screw shaft 173 is rotated in a clockwise direction by the second motor 172 and a screw thread is formed in an outer circumferential surface of the second screw shaft 173 and it is extended in a longitudinal direction of the human body lying on the plate unit 102. The third hinge 174 is extended upward from the second base 171. The second rail 175 is formed in a longitudinal direction of the human body lying on the plate unit 102.

The second slider 176 is provided beyond the second rail 175 and it engages with the second screw shaft 173 to sliding-reciprocate the second rail 175 along the clockwise/counter-clockwise direction rotation. The fourth hinge 177 is provided in the second slider 176.

A middle portion of the second bar 179 is hingedly coupled to the third hinge 174 and an end of the second bar 179 is connected to the fourth hinge 177 via the second link 178. At this time, the linked portion of the second bar 179 with respect to the fourth hinge 177 may be positioned at a position having the different height from the height of the third hinge 174. For that, an end of the second bar 179 may be bending downward and the bent portion is linked to the fourth hinge 177. The other end of the second bar 179 is extended a predetermined length and a second roller 181 is provided in the end of the second bar 179. The second bar 179 may be arranged in a position corresponding to a lower portion of the third main plate 116. The second roller 181 may be provided in a predetermined portion of the second bar 179 toward the human head.

Accordingly, when the second motor 172 is rotated in a clockwise direction as shown in FIG. 18, the second screw shaft 173 is rotated by the rotational force of the second motor 172. As it is moving, the second slider 176 engaging with the second screw shaft 173 pulls the end of the second bar 179 via the second link 178 and the portion of the second bar 179 coupled to the second link 178 is lower than the third hinge 174. As a result, the other end of the second bar 179 is moved upward and the second bar 179 is rotated along the upward moving. After that, the second roller 181 provided in the end of the second bar 179 lifts the third main plate 116 and the first main plate 112 is rotated with respect to the fixed hinge 137, as shown in FIGS. 11 and 12 and 24 and 25, and the fourth main plate 118 is rotated with respect to the fourth or fifth variable hinge 134 or 135 locked by no locking parts, to be tilted.

When the second motor 252 is rotated in the counterclockwise direction, the reverse driving is performed and the second bar 259 is dropped and the third main plate 116 is rotated to be unfolded.

Figure 19:
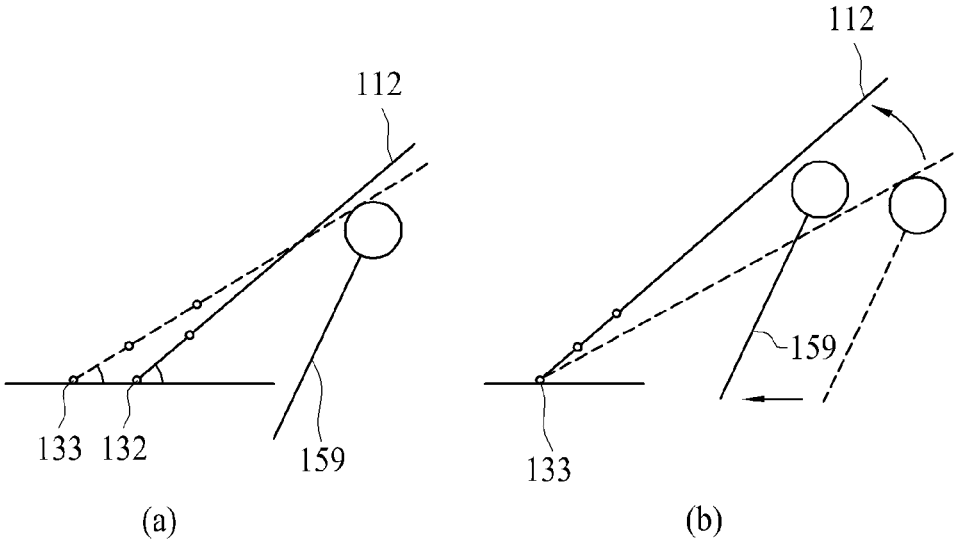
FIG. 19 is a diagram illustrating a tilted angle of the first main plate according to rotation of a shaft provided in the first main plate and the position of the first driving unit, including.

Meanwhile, as shown in FIG. 19(*a*), the first driving unit 150 is driving to move the first bar 159 upward and the first main plate 112 is tilted. The lifted position of the first bar 159 provided in the first driving unit 150 is restricted and a tilted angle of the first main plate 112 can be changed based on which one of the first to third variable hinges 131 to 133 the first main plate 112 is rotated on.

Accordingly, as shown in FIG. 19(*b*), a position adjusting unit 190 may be further provided to adjust the position of the first driving unit 150 to change the first main plate supporting point of the first driving unit 150, such that the tilted angle of the first main plate 112 can be uniform even when the first main plate 112 is rotated on one of the first to third variable hinges 131 to 133.

Figure 20:
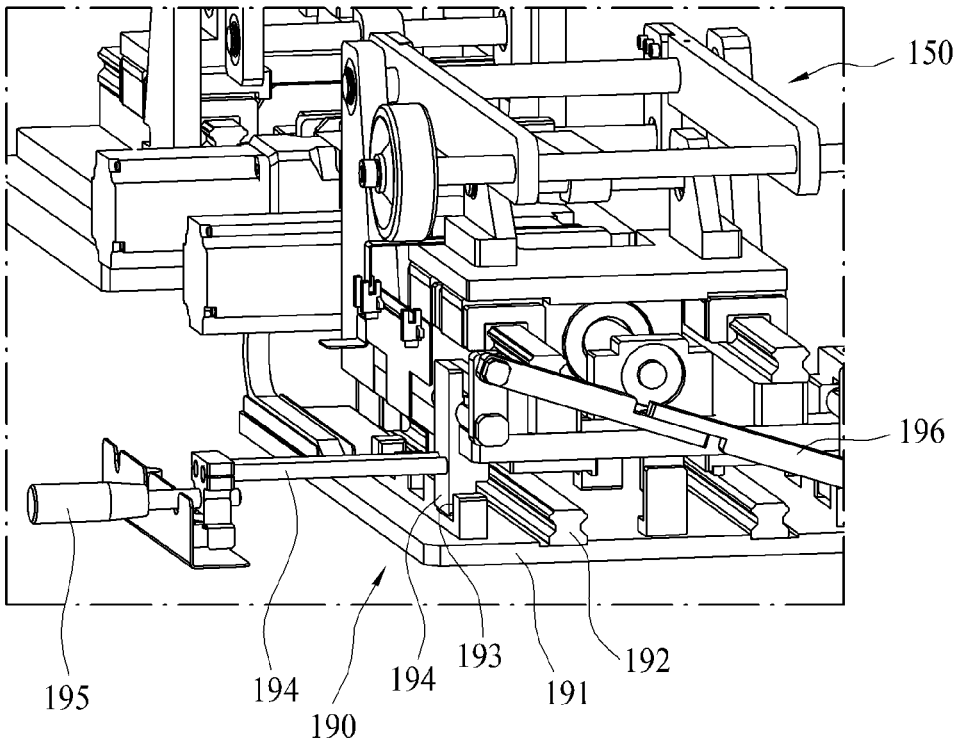
FIG. 20 is a perspective view illustrating a position adjusting part of the platform shown in FIG. 2.
Figure 21:
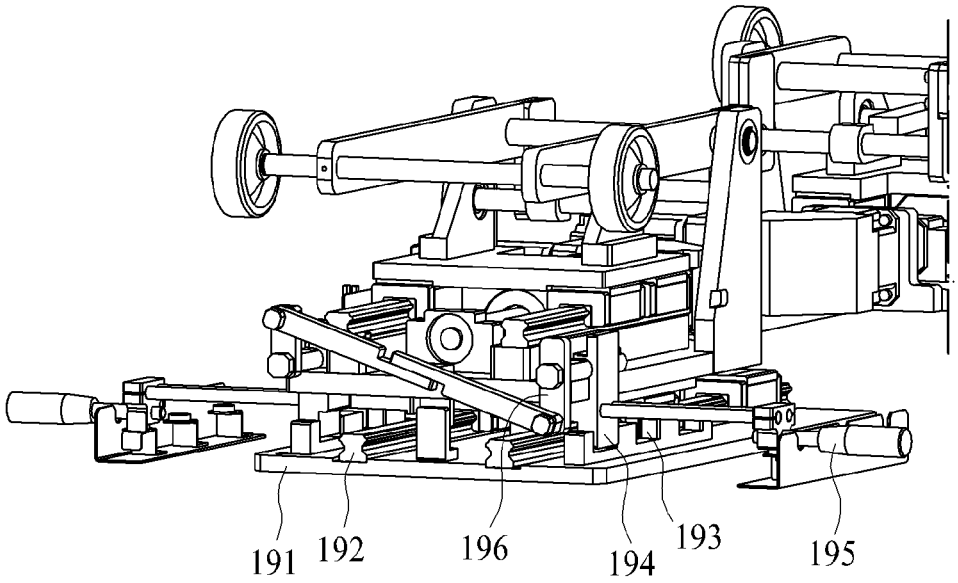
FIG. 21 is a perspective view illustrating the position adjusting part of FIG. 20, seen at another angle.

As shown in FIGS. 20 and 21, the position adjusting unit 190 may include an under base 191 and an under rail 192 and a fixing part 194.

The under base 191 is provided under the first base 151 of the first driving unit 150 within the frame 106. The under rail 192 is provided in the under base 191 and it slidingly supports the first base 151. At this time, the under rail 192 may be arranged in a longitudinal direction of the user's body.

The fixing part 194 selectively restricts the moving of the first base 151 along the under rail 192, to fix the position of the first base 151. The fixing part 194 may include a fixing groove 193, a fixing projection 194 and a lever 195.

A plurality of fixing grooves 193 may be formed in a top surface of the under base 191. The fixing projection 194 is projected downward with respect to the first base 151 and it is rotatable with respect to the first base 151. The fixing projection 194 is inserted in one of the fixing grooves 193 to prevent the moving of the first base 151. The lever 195 rotates the fixing projection 194 to separate from the fixing groove 193 or to be inserted in one of the fixing grooves 193.

The fixing parts mentioned above are provided in both opposite sides of the first driving unit 150. The levers 195 provided in the sides are connected with each other by a third link 196. Even when one of the levers 195 is rotated, the other one is rotated together to separate or insert each fixing projection 194 from or in each fixing groove 193.

Accordingly, the first base 151 is slidingly moving along the under rail 192 in a state where the fixing projection 194 is separated from the fixing groove 193 by rotating the lever 195 upward. After each of the locking units 140 is locked or unlocked to make the rotation axis of the first main plate 112 one of the first to third variable hinges 131 to 133, the position of the position adjusting unit 190 is adjusted and the lever 195 is rotated to the original position to insert the fixing projection 194 in the fixing groove 193 to fix the position of the first base 151. Accordingly, the position of the first driving unit 150 may be adjusted.

A third roller 109 is provided in an end of the frame 106 toward the human feet to support the fourth main plate 118.

As shown in FIGS. 22 to 25, one to rotate out of the variable hinges 131, 132, 133, 134 and 135 of the plate unit 102 is determined to be fitted to the user's body type. After that, the first driving unit 150 and the second driving unit 170 are driven to tilt the plate unit 102. According to the user's taste, a mattress (not shown) or the like may be spread on the plate unit 102.

Figure 22:
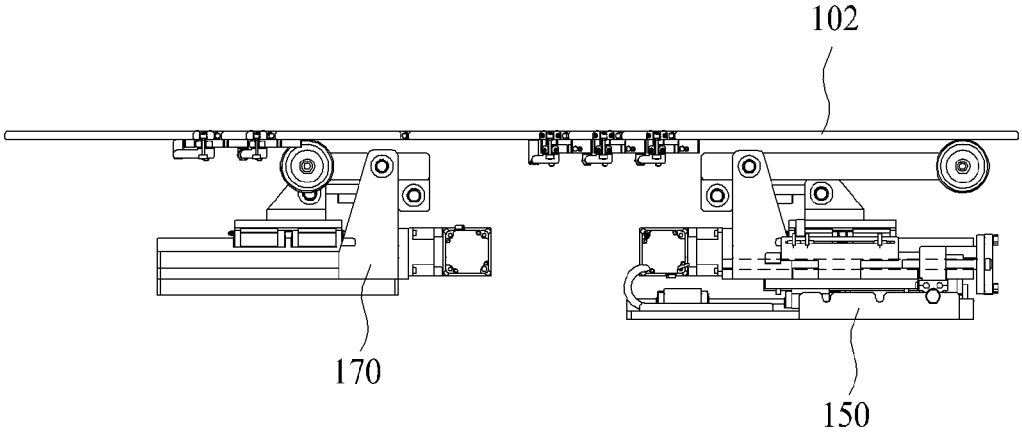
FIG. 22 is a side view illustrating the plate unit of FIG. 2 which has a first posture.
Figure 23:
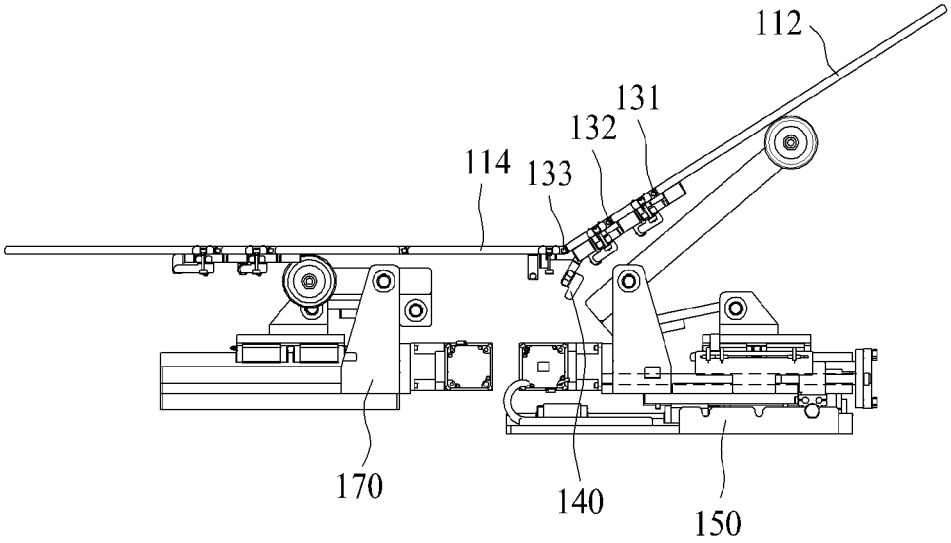
FIG. 23 is a side view illustrating the plate unit of FIG. 2 which is in a second posture.
Figure 24:
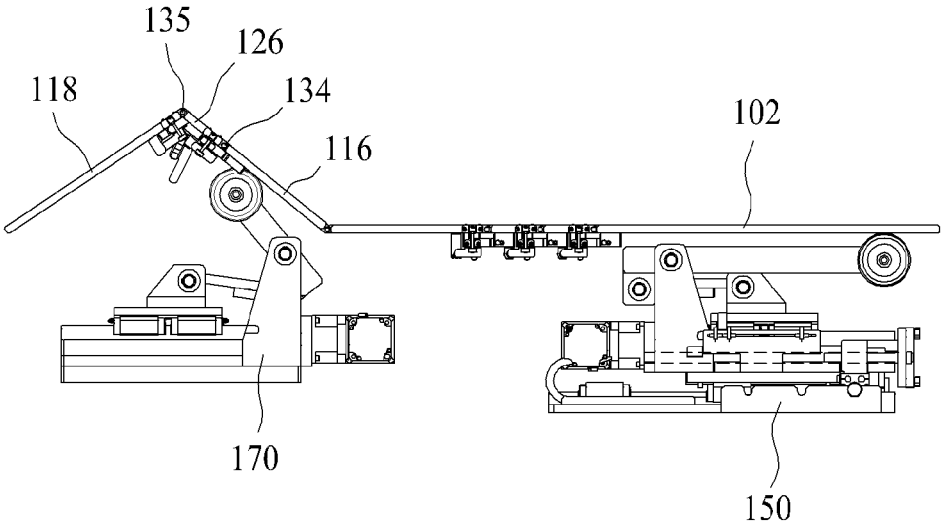
FIG. 24 is a side view illustrating the plate unit of FIG. 2 which is in a third posture.

A state where the plate unit 102 is flat may be referenced to as 'a first posture' as shown in FIG. 22. A state where the first main plate 112 is erected to raise the upper body part of the patient may be referenced to as 'a second posture' as shown in FIG. 23. A state where the first main plate 112 is flat, with the third and fourth main plates 116 and 118 being tilted, to raise the patient's knees may be referenced to as 'a third posture' as shown in FIG. 24. Also, as shown in FIG. 25, a state where the first, third and fourth main plates 112, 116 and 118 are tilted to raise the patient's upper body part, together with raising the knees may be referenced to as 'a fourth posture'.

Moreover, a control unit (not shown) is provided in the platform 100 to control the first driving unit 150 and the second driving unit 170. The control unit fabricated in a substrate type may be provided in the platform or embedded in the input unit 103.

The control unit includes a database for information on a risk level of bedsore occurrence at a specific location of the human body for each specific posture of the user lying on the plate unit 102.

Figures 25, 26:
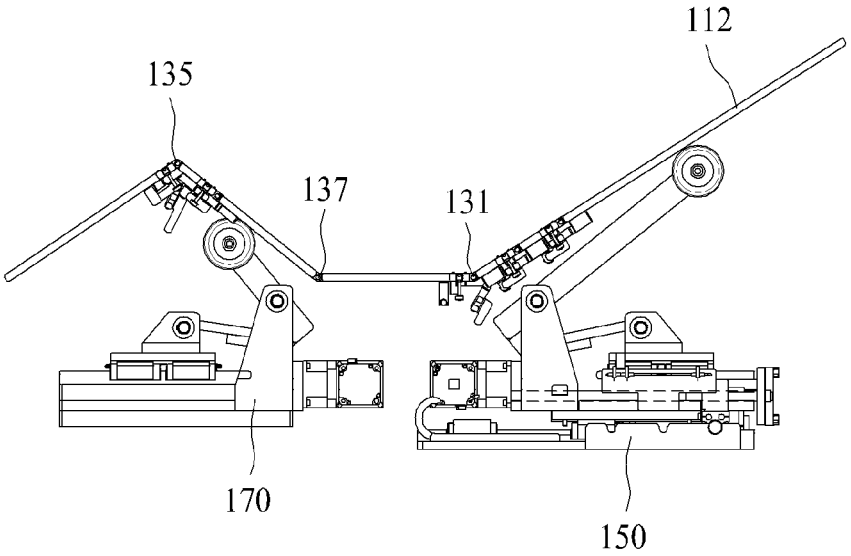
FIG. 25 is a side view illustrating the plate unit of FIG. 2 which is in a fourth posture.
FIG. 26 is a diagram illustrating one example of database according to another aspect of the present invention.

As shown in FIGS. 26 and 27, various bedsore inducing factors are measured to evaluate a risk level of bedsore occurrence at the specific location of the human body for each specific posture and the evaluated data is input to the database, which may be the result deducted from many experiments.

More specifically, the bedsores may be generated by factors including the pressure, the friction force and the shear forces applied to the human skin. Also, the occurrence of the bedsores may be related to a transcutaneous gas partial pressure of the human skin. In this instance, the transcutaneous gas partial pressure may be tcpO2 or tcpCO2, for example.

In other words, as the pressure, friction force and shear forces are getting larger and as the time taken to apply them is getting longer, a risk level of the transcutaneous gas partial pressure is getting high. As tcpCO2 is getting larger and as tcpO2 is getting smaller, a risk level of the transcutaneous gas partial pressure is getting high.

That is, the risk level of the bedsore occurrence is the data including at least one of the pressure and shear forces for each specific location of the human body, tcpCO2 and tcpO2. The risk level is evaluated based on the free posture maintaining time with respect to each specific location of the human body at a specific posture.

Also, the size of the force applied to each location of the human body such as a mean physiognomy or scapula and the risk of the bedsore occurrence may be differentiated. Data on the bedsores occurrence factors for each location of the human body can be input in the database.

Also, the size of the force applied to each location of the human body may be differentiated according to the postures of the human body and the risk of the bedsore occurrence may be differentiated. Data on the bedsore factors for each location of the human body for each posture of the platform 100 may be input in the database.

The risk level of the bedsore occurrence may be differentiated according to the user's weight, age and sex. Data on the risk level of the bedsore occurrence may be input in the database.

Accordingly, the data on the factors is input to the database and the data on the risk level of the bedsore occurrence for each location of the human body according to the posture maintaining time is input to the database.

Together with that, the physical constitution such as the skin subject to the bedsores or characteristics of diseases subject to the bedsores such as blood flow disorders may be closely related to the risk level of the bedsore occurrence. When such characteristics are inputted via the input unit, the control unit applies a weighted value to the data stored in the database.

Considering such the factors, the risk level of the bedsore occurrence applied to a specific location of the human body at a corresponding posture may be expected. To minimize the risk of the bedsore occurrence, the control unit drives the first driving unit 150 and the second driving unit 170 and controls to alternate maintaining one of the first to fourth postures for a predetermined time on a regular cycle.

Of course, even when one of the first to fourth postures is changed into another one, the order of the patient taking a posture not to apply the shear forces to the patient skin after slicked from the first main plate 112, the order of driving the first and driving units, the tilted angle of each main plate and the posture changing time may be adjusted. The order or frequency of the taking each posture may be combined variously.

In the description of this embodiment, the platform 100 is taking one of the first to fourth postures. However, the present invention is not limited to the posture of the platform and it is possible to control the platform in various postures.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A platform of an electric-movable bed capable a shaft comprising:

a plate unit comprising a plurality of main plates rotatably provided to support a human body, a plurality of sub plates rotatably and hingedly coupled to the main plates, respectively, and a locking part provided between each main plate and each sub plate to enable or lock a rotation of each main plate or sub plate, the plate unit being configured to selectively rotate a corresponding portion to a position of a joint according to a user's body type;

a first driving unit configured to tilt an upper part of the human body lying on the plate unit; and a second driving unit configured to tilt a lower part of the human body lying on the plate unit, wherein the locking part comprises, an upper locking body provided in a lateral surface of a main plate or a sub plate out of neighboring main or sub plates; a lower locking body rotatably provided under the other main or sub plate out of two neighboring main or sub plates, the lower locking body extended to a lower portion of the upper locking body; and a locking rod coupled to one of the upper and lower locking bodies, with being extended to be selectively fixed to the other one, the locking rod configured to selectively lock a rotation of the neighboring main or sub plates.

2. The platform as recited in claim 1, wherein the plurality of the sub plates are provided, corresponding to a location of the human bottom and a location of the human knees.

3. The platform as recited in claim 1, wherein the lower locking body is rotatable in the same direction as the rotational direction of the main plates and the sub plates.

4. The platform as recited in claim 1, wherein the locking rod is rotatably coupled to the upper locking body and selectively fixed to the lower locking body.

5. The platform as recited in claim 1, wherein a sensor is provided in the locking part to sense whether the upper locking body, the lower locking body and the locking rod composing the locking part are connected and locked to each other.

6. The platform as recited in claim 1, wherein the first driving unit comprises, a first base;

a first motor provided in the first base;

a first screw shaft rotated by the rotation of the first motor, with being extended in a longitudinal direction of the human body lying on the plate unit, the first screw shaft having a screw thread formed in an outer circumferential surface thereof;

a first hinge formed in a position extended upward from the first base;

a first rail provided in the first base in the longitudinal direction of the human body lying on the plate unit;

a first slider engaging with the first screw shaft rotated by the first motor to be transferred along the first rail together with the rotation of the first screw shaft, the first slider having a second hinge formed at a position having a different height from the height of the first hinge; and a first bar hingedly coupled to the first hinge and hingedly coupled to the second hinge at a position having a different height from the first hinge, to rotate on the first hinge as the first slider is transferred to make an end thereof move the main or sub plate upward.

7. The platform as recited in claim 6, wherein a first roller is provided in an end of the first bar which contacts with the main or sub plate.

8. The platform as recited in claim 6, further comprising: a position adjusting unit configured to adjust a position of the first driving unit.

9. The platform as recited in claim 8, wherein the position adjusting unit comprises, a under base provided under the first base;

a under rail provided in the under base to slidingly support the first base; and a fixing part configured to fix the position of the first base by restricting the moving of the first base along the under rail.

10. The platform as recited in claim 9, wherein the fixing part comprises, a plurality of fixing grooves formed in the under base along a longitudinal direction;

a fixing projection rotatably projected from the first base downward to be inserted in one of the fixing grooves to fix the first base to the under base; and a lever configured to rotate the fixing projection to selectively separate the fixing projection from the fixing groove.

11. The platform as recited in claim 1, wherein the second driving unit comprises, a second base;

a second motor provided in the second base;

a second screw shaft rotated by the rotation of the second motor, with being extended in a longitudinal direction of the human body lying on the plate unit, the second screw shaft having a screw thread formed in an outer circumferential surface thereof;

a third hinge formed in a position extended upward from the second base;

a second rail provided in the second base in the longitudinal direction of the human body lying on the plate unit;

a second slider engaging with the second screw shaft rotated by the second motor to be transferred along the second rail together with the rotation of the second screw shaft, the second slider having a fourth hinge formed at a position having a different height from the height of the third hinge; and a second bar hingedly coupled to the third hinge and hingedly coupled to the fourth hinge at a position having a different height from the third hinge, to rotate on the third hinge as the second slider is transferred to make an end thereof move the main or sub plate upward.

12. The platform as recited in claim 11, wherein a second roller is provided in a contacting portion of the second bar with the main or sub plate.

13. The platform as recited in claim 1, further comprising: an input unit configured to input data on the user's physical conditions thereto.

* * * * *